United States Patent [19]

Oh

[11] Patent Number: 4,894,502

[45] Date of Patent: Jan. 16, 1990

[54] AUTOMATIC COOKING CONTROL SYSTEM FOR A MICROWAVE OVEN

[75] Inventor: Ki T. Oh, Kyungsangnam, Rep. of Korea

[73] Assignee: Goldstar Co., Ltd., Seoul, Rep. of Korea

[21] Appl. No.: 256,964

[22] Filed: Oct. 13, 1988

[30] Foreign Application Priority Data

Oct. 13, 1987 [KR] Rep. of Korea ..... 11354/1987

[51] Int. Cl.[4] ..... H05B 6/68

[52] U.S. Cl. ..... 219/10.55 M; 219/10.55 B; 99/325

[58] Field of Search ..... 219/10.55 B, 10.55 R, 219/10.55 M, 10.55 E, 460, 492; 99/325, DIG. 14

[56] References Cited

U.S. PATENT DOCUMENTS 4,115,678 9/1978 Tachikawa et al. ..... 219/10.55 B
4,162,381 7/1979 Buck ..... 219/10.55 B
4,812,606 3/1989 Eke ..... 219/10.55 B
4,831,227 5/1989 Eke ..... 219/10.55 M

*Primary Examiner*—Philip H. Leung
*Attorney, Agent, or Firm*—Birch, Stewart, Kolasch & Birch

[57] ABSTRACT

An automatic cooking control system for a microwave oven utilizes an initial operation process which determines an initial operation process which determines a temperature increment compensating portion from a temperature variation and a temperature difference. The system also utilizes a first stage heating process which executes heating operations until the air temperature of the air flowing out of a heating chamber is raised as much as the compensated temperature increment. A second stage heating process is also utilized to execute a heating operation for a period of time that is equal to the first stage heating period of time multiplied by a predetermined value. The predetermined value is set according to the kind of food being cooked. Even if one is cooking a new food immediately after another food has been cooked, the food can be automatically cooked correctly and optimally.

12 Claims, 5 Drawing Sheets

FIG, 1
PRIOR ART
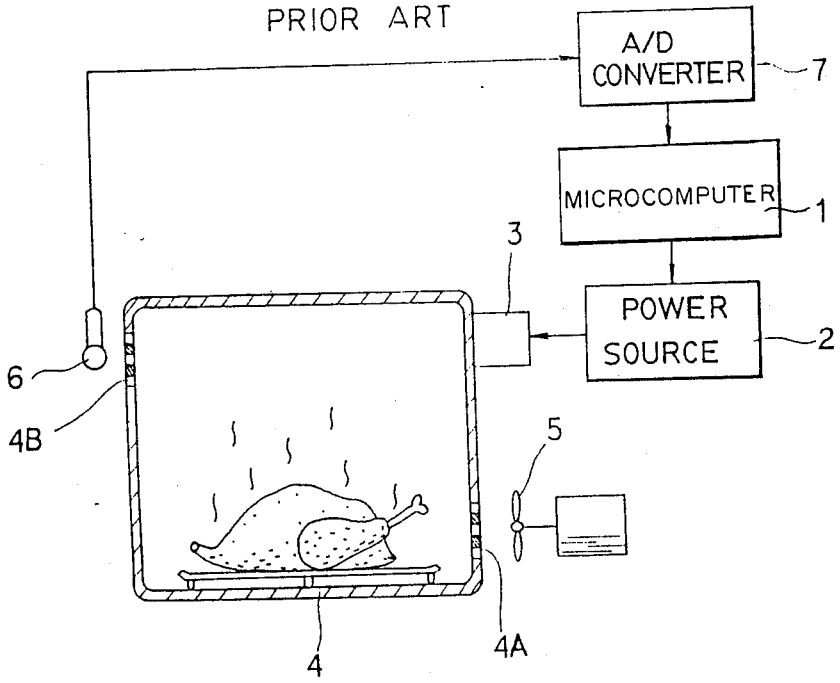
FIG, 3
PRIOR ART
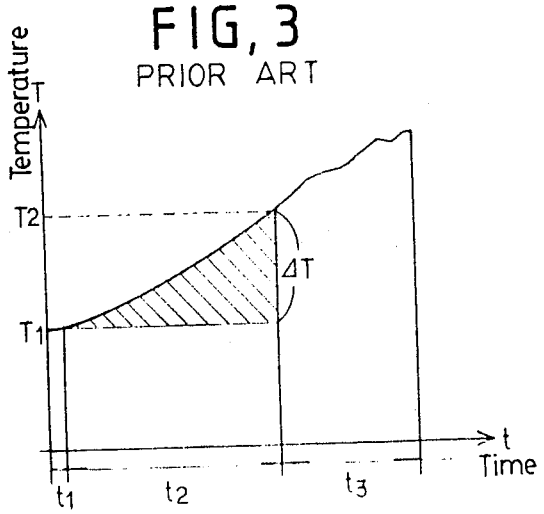

FIG, 2 PRIOR ART
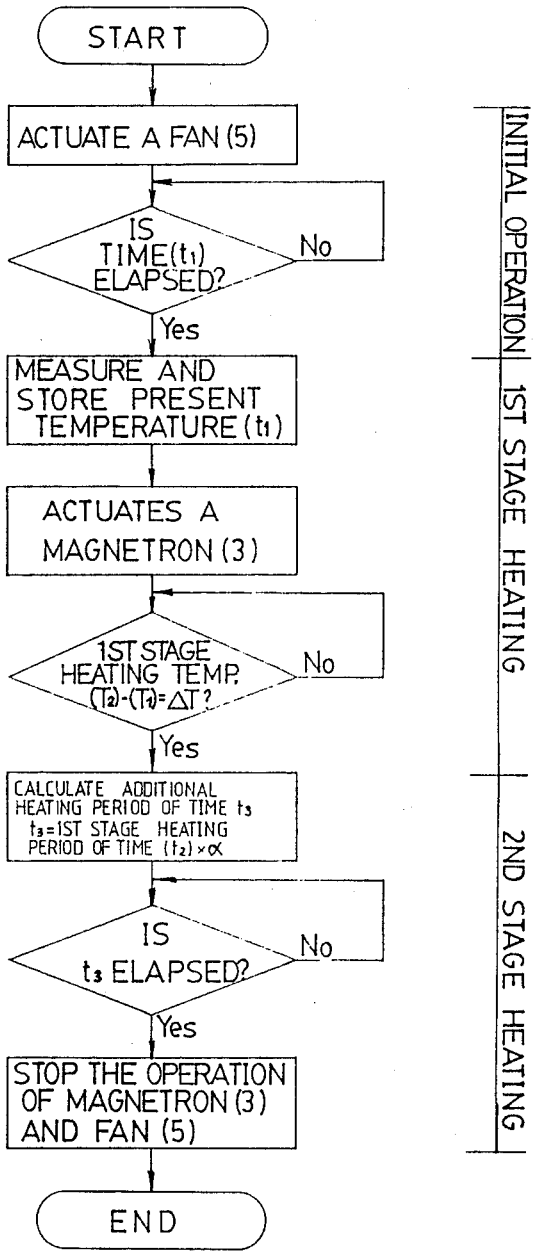

FIG, 4A
PRIOR ART
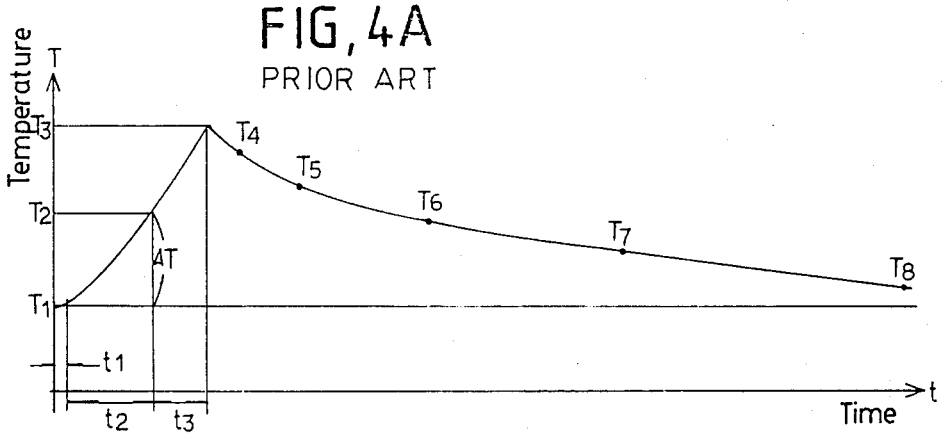
FIG, 4B
PRIOR ART
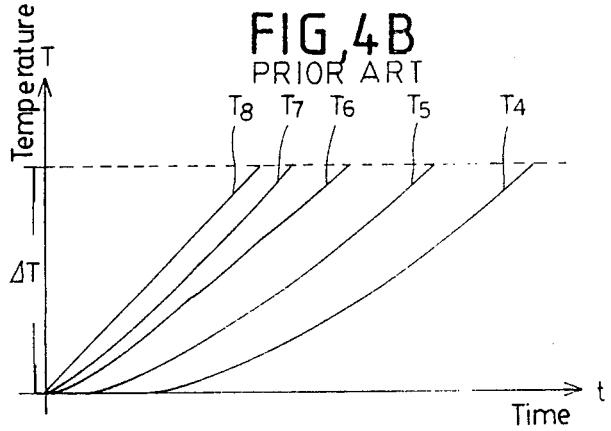
FIG, 5
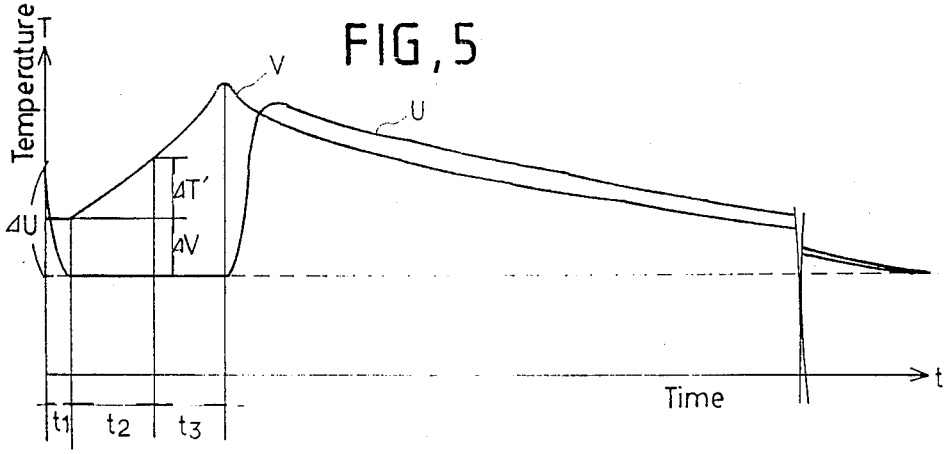

FIG, 6
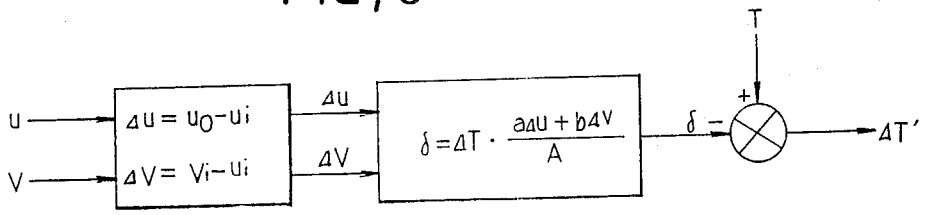
FIG, 7
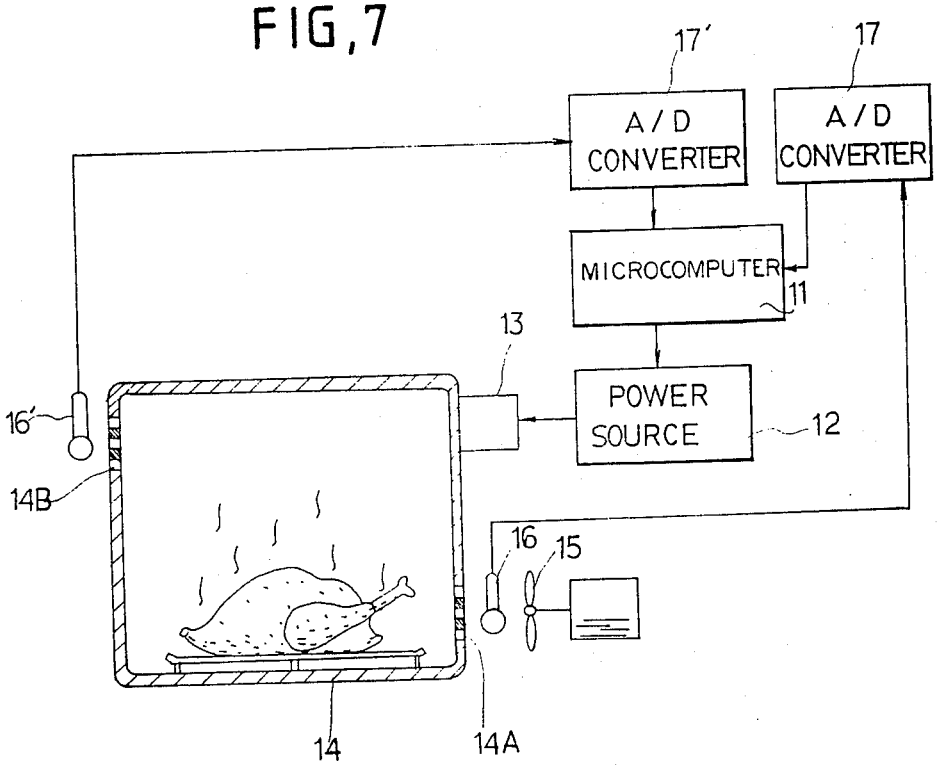

AUTOMATIC COOKING CONTROL SYSTEM FOR A MICROWAVE OVEN

BACKGROUND OF THE INVENTION

The present invention relates to an automatic cooking control system for a microwave oven which automatically cooks a food contained in a heating chamber by utilizing temperature detecting sensors. More specifically, the present invention relates to an automatic cooking control system for a microwave oven which is allowed to cook by correctly establishing a heating period of time for a food even if foods are successively cooked. In other words, when a microwave oven is being utilized again after a first portion of food is cooked to immediately cook another portion of food.

A conventional microwave oven, as shown in FIG. 1, with a microcomputer 1 which controls the whole operation of a microwave oven; a power source 2 which supplies the electric power according to the control of the microcomputer, a magnetron 3 which generates microwave energy upon being actuated by an output of electric power from the power source 2, a heating chamber 4 which heats food with the microwave energy generated from the magnetron 3; a fan 5 which blows an air through an air inlet 4A into the heating chamber 4; a temperature detecting sensor 6 which detects a temperature of an air flowed out through an air outlet 4B of the heating chamber 4; an analog/digital converter 7 which converts a temperature signal of the outflow air detected by the temperature detecting sensor 6 into a digital signal and supplies the digital signal to the microcomputer 1.

The conventional microwave oven as described above, when a user begins the cooking process by putting a food to be cooked into the heating chamber 4 starts the cooking cycle by pressing a cooking start button. The microcomputer 1 performs an initial operation for a predetermined period of time $t_1$, as shown in FIGS. 2 and 3. During this period, the air temperature of the heating chamber 4 is made uniformed by blowing an air into the heating chamber 4 through an air inlet 4A. This is achieved by actuating a fan 5 for about sixteen seconds, a temperature of the air flowing out through an outlet 4B of the heating chamber 4 is detected by a temperature detecting sensor 6. Then the detecting temperature signal is converted into a digital signal by an analog/digital converter 7.

When a predetermined period of time $t_1$ has elapsed, the microcomputer receives and stores a signal representing the presently existing temperature $T_1$ which has been outputted from the analog/digital converter 7. Thereafter, the microcomputer 1 actuates a magnetron 3 by controlling a power source 2. When the magnetron 3 is actuated, the magnetron 3 is allowed to heat the food contained in the heating chamber 4 by generating microwave energy. The temperature of the air flowing through the air outlet 4B of the heating chamber 4 is gradully raised in accordance with the heating of the food; therefore, a temperature detection signal which is inputted to the microcomputer 1 through the analog/-digital converter 7 is gradually raised.

When the air temperature is raised an increment that is equal to a predetermined value $\Delta T$, that is when the temperature detected at a temperature detecting sensor 6 is raised to a predetermined temperature T2, the microcomputer 1 finishes a first stage heating process and starts to execute a second stage heating process a period of time $t_2$ to execute a first stage heating process is stored. A second stage heating period of time $t_3$ is then calculated by multiplying a predetermined value $\alpha$ established in accordance with the kind of food being cooked with the period of time $t_2$. The food is heated by continuously actuating the magnetron 3 during the second stage heating for period of time $t_3$. When the second stage heating proces period of time $t_3$ is elapsed, the operation of a magnetron 3 and a fan 5 is halted, and the cooking of the food is completed.

However, in the conventional automatic cooking control system, as described above, when another food is cooked immediately under after a microwave oven has been used to heat an initial food portion, the automatic cooking of the food cannot be readily accomplished because the temperature increasing rate becomes non-existent relative to the increasing rate realized during the cooking of the initial food portion.

As shown in FIG. 4A, when cooking another food at a temperature $T_4$, $T_5$, $T_6$, $T_7$, or $T_8$ that is higher than a normal temperature $T_1$, the air temperature at an air outlet 4B which is detected by the temperature detecting sensor 6 is raised to a predetermined temperature $T_3$. Thereafter, the air temperature is gradually cooled, as shown in FIG. 4B. Since a first stage heating period and a second stage heating period will become longer when the temperature increasing rate decreases in accordance with the condition that a starting cooking temperature is still high, the food is over heated. This situation causes a disadvantage in that a food can only be automatically cooked when at least 10–30 minutes have elapsed after the initial food is cooked.

SUMMARY OF THE INVENTION

Therefore, the object of the present invention is to provide an automatic cooking control system which is able to automatically cook food correctly and optimally even when the cooking cycle of new food is started immediately after the initial food.

The object of the present invention is accomplished by detecting a temperature variation in the air which is flowing into and out of a heating chamber during an initial operating period of time for a microwave oven, and then by re-establishing a temperature increment in accordance with the detected temperature variation.

BRIEF DESCRIPTION OF THE DRAWINGS

FIG. 1 is a schematic diagram illustrating a configuration of a conventional microwave oven.

FIG. 2 is a signal flow chart of a microcomputer which is utilized in a conventional microwave oven.

FIG. 4A is a graph showing a temperature variation when a conventional microwave oven initially cooks food.

FIG. 4B is a graph showing temperature increasing rates associated with the actuation of a microwave oven at the respective temperatures of FIG. 4A.

FIG. 5 is a graph illustrating a temperature variation of air flowing into and out of a heating chamber during continuous cooking.

FIG. 6 is a block diagram illustrating a principle of the present invention.

FIG. 7 is a schematic diagram illustrating a configuration of a microwave oven of the present invention.

FIG. 8 is a signal flow chart of a microcomputer according to the present invention.

DETAILED DESCRIPTION OF THE INVENTION

Figure 8:
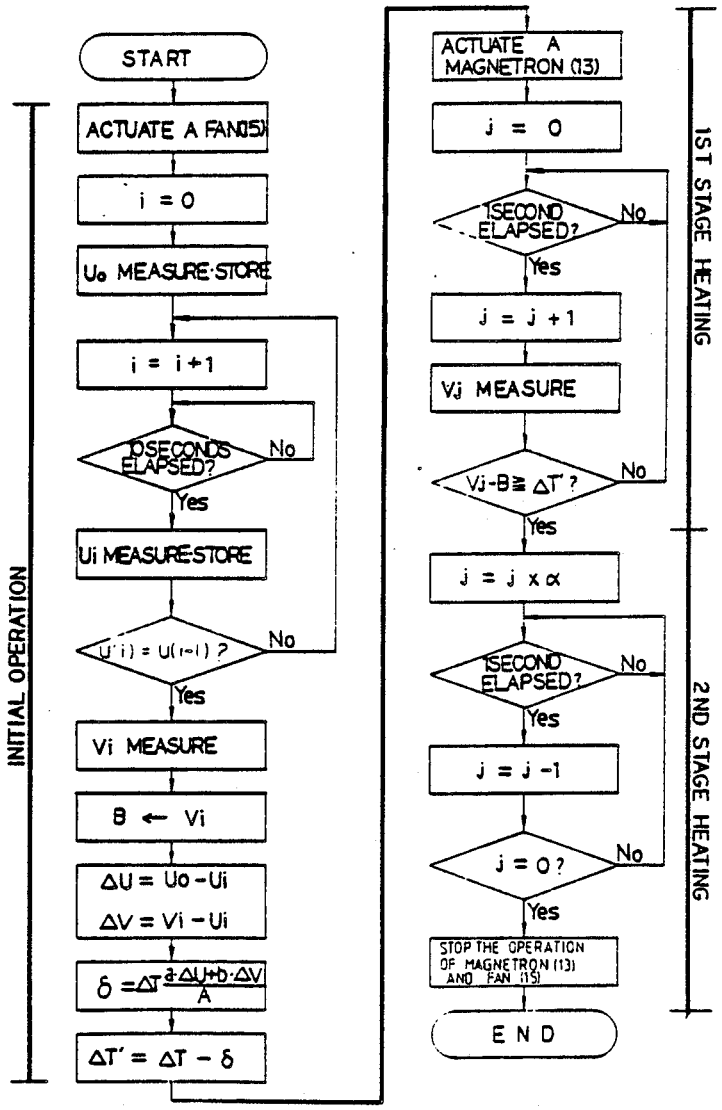
FIG. 8 is a graph illustrating a temperature variation in accordance with an operation of a conventional microwave oven.

With respect to a temperature variation in the air flowing into and out of a heating chamber during continuous cooking of a food as shown in FIG. 5, firstly, a temperature U of the air flowing in during an initial period of time of continuous cooking becomes similar to the ambient temperature of the exterior of the microwave oven by being lowered at a rapid speed. Secondly, temperature values U and V of the air flowing and out of, respectively, the heating chamber, during a first stage and a second stage heating are different.

In the above case, when a microwave oven stops the heating operation of a food, the various parts of the interior of the microwave oven as a magnetron are still hot due to a fan being not actuated. The heat of these various parts remains within the interior of the microwave oven so that the temperature in the vicinity of the air inlet of the heating chamber is raised. When a microwave oven is actuated, the fan is actuated, and the air temperature U of the air inlet is lowered rapidly until it becomes equal to the ambient temperature of the exterior due to the air of the exterior being blown into the heating chamber.

Though the temperature U of the inflow air is lowered rapidly due to the exterior air being blown in, the heating chamber is not cooled so rapidly but cooled at a slow rate causing a difference between the temperature V of outflow air and the temperature U of inflow air occur.

A temperature variation $\Delta U$ of inflow aid and a difference $\Delta V$ between the temperatures U and V of the air flowing in and out become closely proportional to each other during continuous cooking, as following, when a temperature variation $\Delta U$ and a temperature difference $\Delta V$ are respectively multiplied by appropriate additional values a and b and thereafter added together, the value represents a function for a period of time of continuous cooking. This value is established by the following:

$$a.\Delta U + b.\Delta V$$

The additional values a and b are the values that are sought experimentally, accordingly these values become different in accordance with the magnitude of the heating chamber and the like.

In addition, if the above expression is divided by an appropriate experimental coefficient A, it becomes less than 1, and if this new value is multiplied by a proper temperature increment $\Delta T$ representing a food to be cooked, temperature increment compensating portion value falling between zero and the temperature increment T can be obtained. The expresseion for obtaining the temperature increment compensating portion value is as follows:

$$\delta = \Delta T \cdot \frac{a \cdot \Delta U + b \cdot \Delta V}{A}$$

Therefore, a compensated temperature increment $\Delta T'$ is obtained by subtracting a temperature increment compensating portion $\delta$ from the original temperature increment $\Delta T$. The magnitude of the compensated temperature increment $\Delta T$ becomes almost same as a temperature increment $\Delta T$ when the temperature variation $\Delta U$ and the temperature difference $\Delta V$ are almost zero as when a food is initially cooked. However, when continuous cooking is executed, the compensated temperature increment $\Delta T'$ becomes less than the temperature increment $\Delta T$ because the temperature variation $\Delta U$ and the temperature difference $\Delta V$ realize a predetermined value which difference representes a degree that establishes a period of time for executing the continuous cooking.

The principle as described above is represented by a block diagram, as shown in FIG. 6.

The present invention utilizing the principle as described above, will be explained in detail below, using to FIGS. 7 and 8.

FIG. 7 is a schematic diagram illustrating a configuration of a microwave oven ussing the method of the present invention. As shown in FIG. 7, the present invention comprises a microcomputer 11 which controls the whole operations of a microwave oven; a power source 12 which supplies the electric power in accordance with the control of the microcomputer 11; a magnetron 13 which generates a microwave energy by being actuated in accordance with the electric power supplied by the power source 12; a heating chamber 14 which heats the food using the microwave energy generated by the magnetron 13, a fan 15 which blows air through an air inlet 14A of the heating chamber 14; temperature detecting sensors 16 and 16' which detect the temperature of the air flowing in and out of the heating chamber 14 by being mounted respectively, at the air inlet 14A and air outlet 14B of the heating chamber 14; and analog/digital converters 17 and 17' which convert the air temperature signals detected by the temperature detecting sensors 16 and 16' into the digital signals and input these signals into the microcomputer 11.

In the present invention, when food to be cooked is put in a heating chamber 14 and automatic cooking is started by pressing a cooking start button, as shown in FIG. 8, a fan 15 is actuated by a microcomputer 11 to blow air into the heating chamber 14. After a variable i is set to zero, the temperature $U_0$ of the air blown through an air inlet 14A is measured and stored the temperature is detected by a temperature detecting sensor 16 mounted at the air inlet 14A at the initial moment that the microwave oven is actuated. The temperature signal $U_0$ of the initial inflow air is converted into a digital signal by the analog/digital converter 17. After 10 seconds have elapsed, the variable i is incremented by one, and a present temperature Ui of the inflow air is measured and stored. The reason for setting a period of time to 10 seconds is to give enough time for the inflow air temperature Ui to become uniformed with the ambient temperature of the exterior. This sampling period of time allows the microcomputer to determine whether the inflow air temperature Ui and an exterior ambient temperature are equal or not.

Thus, when the presently existing temperature Ui of the inflow air is measured and stored, whether or not the presently existing temperature Ui is equal to the initial temperature $U_0$ is determined by the microcomputer 11, by comparing the present inflow air temperature Ui with an inflow air temperature Ui−1, measured 10 seconds before. The present temperature are measured continuously and repeatedly until the temperatures Ui and Ui−1 are equal. When the temperatures Ui and Ui−1 are equal then an out flow air temperature Vi is measured. The outflow air temperature Vi which is detected by a temperature detecting sensor 16' mounted at an air outlet 14B is converted into a digital signal by an analog/digital converter 17' a register B, and stored in a register B. Thereafter a temperature variation ΔU and a temperature difference ΔV are calculated. The temperature variation ΔU is calculated by subtracting the presently existing temperature Ui of the inflow with the temperature of the exterior ambient air from an initial inflow air temperature $U_0$. The temperature difference ΔV is calculated by subtracting the presently existing inflow air temperature Ui from the presently existing outflow air temperature Vi.

Thus, when the temperature variation ΔU and the temperature difference ΔV are obtained, the experimentally determined additional values a and b are respectively multiplied with the temperature variation ΔU and the temperature difference ΔV via the microcomputer 11. The products are added together and the same is multiplied by a temperature increment ΔT according to the kind of food to be cooked. A temperature increment compensating portion δ is obtained by dividing the product by an experimental coefficient A. The temperature increment ΔT can be compensated by subtracting the temperature increment compensating portion δ from a temperature increment ΔT. This completes the initial operation.

Thus, when the initial operation is completed, the food is heated by actuating a magnetron 13 via the microcomputer 11. The variable j is incremented by 1 during the heating process when 1 is added to said variable j, with repeating to measure an air temperature Vj flowing out through an air outlet 14B of a heating chamber 14 is measured. Whether or not the present outflow air temperature Vj is increased more than a compensated temperature increment ΔT' is determined. An outflow air temperature Vi stored in the register B is subtracted from the present outflow air temperature Vj and the above described operation is repeated until the difference is more than the compensated temperature increment ΔT. When the outflow air temperature Vj is increased as much as the compensated temperature increment ΔT, a first stage heating operation is completed.

Thus, when the first stage heating operation is completed, a predetermined value α which is established in accordance with the kind of food being cooked, is multiplied with the variable j via the microcomputer 11 is subtracted from the variable j for every second being elapsed, when the variable j is equal to zero, the operation of the magnetron 15 and a fan 13 are stopped and a second stage heating operation is completed.

The automatic cooking of a food is completed by performing the operations described above.

The present invention as described above will now be explained in detail using the following comparative examples wherein the example considers four potatoes being automatically cooked.

COMPARATIVE EXAMPLE 1

A temperature increment ΔT and a predetermined value α were obtained when four potatoes were automatically cooked under a standard condition.

$\Delta T = 9°$ C.

$\alpha = 1.0$

When cooking was performed unter the condition that a microwave oven was heated not using the temperature increment ΔT and a predetermined value α as described above, the period of time for performing both the first stage and second stage heating process was about 600 seconds.

COMPARATIVE EXAMPLE 2

When the four potatoes were continuously cooked, under the condition that the microwave oven was heated, using a temperature increment ($\Delta T = 9°$ C.) and a predetermined value ($\alpha = 1.0$) as described above the period of time for performing the first stage and second stage heating process was was about 1000 seconds, thereby ruining the eating of the four potatoes due to being overcooked.

EXAMPLE

Under the same condition as described above in example 2, according to the present invention, the additional values a and b established, respectively to be 1, 2 and a coefficient A was established to be 50. Using these values thereafter the four potatoes were automatically cooked.

The temperature variation ΔU and the temperature difference ΔV were measured as follows:

$\Delta U = U_0 - Ui = 9°$ C.

$\Delta V = Vi - Ui = 8°$ C.

In addition, a temperature increment compensating portion δ and a compensated temperature increment ΔT' were obtained as follows:

$$\begin{aligned} \delta &= \Delta T \frac{a \cdot \Delta U + b \cdot \Delta V}{A} \\ &= 9 \times \frac{1 \times 9 + 2 \times 8}{50} \\ &= 4.5 \\ \Delta T' &= \Delta T - \delta = 9 - 4.5 = 4.5 \end{aligned}$$

Thus, when the first stage heating was executed until the outflow air temperature Vj was raised as such as the compensated temperature increment ΔT', the heating period of time was about 310 seconds. The second heating period of time was for about 310 seconds. Therefore, the whole period of time to heat the four potatoes was about 620 seconds, thereby producing four very well cooked potatoes. The automatic cooking of the present invention, as described above, since is performed by re-establishing the temperature increment in accordance with a temperature variation in an air which is blow into and flowing out of the heating chamber. The automatic cooking effectively and correctly performed even if the food is continuously cooked.

What is claimed is:

1. A method of optimally cooking food in a microwave oven having a heating chamber, a fan and a magnetron and using an automatic cooking control system, comprising the steps of:

(a) actuating the fan to cause an air temperature in an interior of the heating chamber to become uniform;

(b) setting a first variable to zero;

(c) measuring and storing a first incremental value for a first temperature of air flowing into the heating chamber, the first incremental value being related to a present value of the first variable;

(d) incrementing the first variable by one;

(e) delaying for a period of ten seconds;

(f) measuring and storing the first incremental value for the first temperature of the air flowing into the heating chamber;

(g) determining if a present first incremental value is equal to the first incremental value measured ten seconds previously;

(h) measuring a second incremental value for a second temperature of air flowing out of the heating chamber, when the present first incremental value is equal to the first incremental value measured ten seconds previously, the second incremental value being related to the present value of the first variable;

(i) storing the second incremental value as a first reference value;

(j) calculated a first temperature difference, the first temperature difference being equal to a difference between the first incremental value when the first variable is equal to zero and the present first incremental value;

(k) calculating a second temperature difference, the second temperature difference being equal to a difference between the present incremental value and the present first incremental value;

(l) calculating a temperature compensation value;

(m) calculating a compensated temperature by adding a predetermined temperature difference to the temperature compensation variable;

(n) actuating the magnetron for a first period of time; and (o) actuating the magnetron for a second period of time, thereby automatically cooking food in the microwave oven.

2. The method as claimed in claim 1, further comprising the step of:

(p) repeating steps (d), (e), and (f) when the present first incremental value is equal to the first incremental value measured ten seconds previously.

3. The method as claimed in claim 1, wherein said step (n) comprises the steps of:

(p) setting a second variable equal to zero;

(q) delaying for one second;

(r) incrementing the second variable by one;

(s) measuring and storing a third incremental value for the second temperature of the air flowing out of the heating chamber, the third incremental value being related to the present value of the second variable;

(t) calculating a difference between the third incremental value and the first reference value;

(u) determining if the difference of said step (t) is greater than or equal to the compensated temperature; and (v) executing said step (o) when the difference of said step (t) is greater than or equal to the compensated temperature.

4. The method as claimed in claim 3, further comprising the step of:

(w) repeating steps (q), (r), (s), (t) and (u) when the difference of said step (t) is less than the compensated temperature.

5. The method as claimed in claim 3, wherein said step (o) comprises the steps of:

(w) multiplying the second variable by a predetermined coefficient;

(x) delaying for one second;

(y) decrementing the second variable by one;

(z) determining if the second variable is equal to zero; and (aa) deactuating the magnetron when the second variable is equal to zero.

6. The method as claimed in claim 5, further comprising the step of:

(bb) repeating said steps (x), (y), and (z) when the second variable is not equal to zero.

7. A method of cooking food in a microwave oven having a heating chamber, a fan and a magnetron and using an automatic cooking control system, comprising the steps of:

(a) actuating the fan to cause an air temperature in an interior of the heating chamber to become uniform;

(b) setting a first variable to zero;

(c) measuring and storing a first incremental value for a first temperature of air flowing into the heating chamber, the first incremental value being related to a present value of the first variable;

(d) incrementing the first variable by one;

(e) delaying for a period of ten seconds;

(f) measuring and storing the first incremental value for the first temperature of the air flowing into the heating chamber;

(g) determining if a present first incremental value is equal to the first incremental value measured ten seconds previously;

(h) measuring and storing a second incremental value for a second temperature of air flowing out of the heating chamber when the present first incremental value is equal to the first incremental value measured ten seconds previously, the second incremental value being related to the present value of the first variable;

(i) storing the second incremental value as a first reference value;

(j) determining a compensated temperature from the first and second incremental values;

(k) actuating the magnetron for a first period of time; and (l) actuating the magnetron for a second period of time.

8. The method as claimed in claim 7, further comprising the steps of:

(m) repeating steps (d), (e), and (f) when the present first incremental value is equal to the first incremental value measured ten seconds previously.

9. The method as claimed in claim 7, wherein said step (k) comprises the steps of:

(m) setting a second variable equal to zero;

(n) delaying for one second;

(o) incrementing the second variable by one;

(p) measuring and storing a third incremental value for the second temperature of the air flowing out of the heating chamber, the third incremental value being related to the present value of the second variable;

(q) calculating a difference between the third incremental value and the first reference value;

(r) determining if the difference of said step (q) is greater than or equal to the compensated temperature; and (s) performing said step (l) when the difference of said step (q) is greater than or equal to the compensated temperature.

10. The method as claimed in claim 9, further comprising the step of:

(t) repeating steps (n), (o), (p), (q), and (r) when the difference of said step (q) is less than the compensated temperature.

11. The method as claimed in claim 9, wherein the step (l) comprises the steps of:

(t) multiplying the second variable by a predetermined coefficient;

(u) delaying for one second;

(v) decrementing the second variable by one;

(w) determining if the second variable is equal to zero; and (x) deactuating the magnetron when the second variable is equal to zero.

12. The method as claimed in claim 11, further comprising the step of:

(y) repeating said steps (u), (v), and (w) when the second variable is not equal to zero.

* * * * *